US006003354A

United States Patent [19]

Ginzburg

[11] Patent Number: 6,003,354

[45] Date of Patent: Dec. 21, 1999

[54] EXTRUSION ROLLING METHOD AND APPARATUS

[75] Inventor: Vladimir B. Ginzburg, Pittsburgh, Pa.

[73] Assignees: Danieli United, A Division of Danieli Corporation; International Rolling Mill Consultants, Inc., both of Pittsburgh, Pa.

[21] Appl. No.: 09/217,942

[22] Filed: Dec. 22, 1998

[51] Int. Cl.[6] ..... B21B 39/08

[52] U.S. Cl. ..... 72/205

[58] Field of Search ..... 72/199, 200, 201, 72/202, 205, 229

[56] References Cited

U.S. PATENT DOCUMENTS

| | | | |
|---|---|---|---|
| 3,709,017 | 1/1973 | Vydrin et al. | 72/205 |
| 4,106,318 | 8/1978 | Yanagimoto et al. | 72/199 |
| 4,244,203 | 1/1981 | Pryor et al. | 72/205 |
| 4,781,050 | 11/1988 | Winter et al. | 72/241 |
| 5,660,070 | 8/1997 | Muryn et al. | 72/229 |
| 5,809,817 | 9/1998 | Ginzburg | 72/8.6 |

*Primary Examiner*—Joseph J. Hail, III
*Assistant Examiner*—Rodney Butler
*Attorney, Agent, or Firm*—Armstrong, Westerman, Hattori, McLeland & Naughton

[57] ABSTRACT

The present invention is an apparatus and method for reducing the total number of required rolling passes of a metal strip in a cold rolling mill to achieve a desired strip thickness. This is accomplished by increasing the exit strip tension of the metal up to 85% of the yield strength Y of the metal strip. This increase in exit strip tension allows a manufacturer to process strip in an apparatus at a maximum thickness reduction of about 50 to 55% in a single rolling pass. At the same time, the increased exit strip tension will result in a reduced lever arm of the work roll of the cold rolling mill and will substantially reduce all of the roll separating force, motor torque and roll mill power of the apparatus.

6 Claims, 4 Drawing Sheets

EXTRUSION ROLLING METHOD AND APPARATUS

FIELD OF THE INVENTION

The present invention is an apparatus and method for reducing the number of required rolling passes of metal strip to achieve a desired thickness.

BACKGROUND OF THE INVENTION

Presently, in cold rolling mills, the entry strip tension of metal strip, for example steel strip, is selected in the range between 4 to 6% of the yield strength Y of the metal strip for the first pass and between 35 to 65% for subsequent passes. The exit strip tension is selected approximately between 35 to 65% of the strip yield strength Y, except for the last pass when the exit tension of the metal strip is limited to 5 to 10% of the strip yield strength Y. Under these conditions, the maximum thickness reduction of metal strip in one rolling pass is usually limited to 40–45%. Because of that, the number of rolling passes during cold rolling can be as many as five passes. Typifying these conditions is U.S. Pat. No. 5,660,070 (1997) which discloses the utilization of tension bridles in a twin stand cold rolling mill to achieve a reduction only as high as 35-40% of the total desired reduction in a single pass.

The present invention significantly overcomes the limitation of reduction of metal strip to a maximum of 40–45%. The apparatus and method of the present invention may be adapted to existing rolling mills without specially sized or configured work rolls as in U.S. Pat. No. 4,244,203 and U.S. Pat. No. 4,781,050.

OBJECTS OF THE INVENTION

It is the principle object of the invention to provide a metal strip rolling apparatus and method to reduce the number of required rolling passes of a metal strip in order to achieve a desired thickness.

It is another object of the present invention to increase the productivity of a rolling mill.

It is a further object of the invention to increase the efficiency of a rolling mill.

Other objects, features and advantages of the present invention will become apparent from the following detailed description taken in conjunction with the accompanying drawings.

SUMMARY OF THE INVENTION

The present invention is an apparatus and method for reducing the number of required rolling passes of a metal strip, for example steel strip, in a cold rolling mill to achieve a desired strip thickness. This is accomplished by increasing the exit tension of the strip up to 85% of the yield strength Y of the rolled strip. This increase in exit strip tension allows a manufacturer to process metal strip in an apparatus at a maximum thickness reduction of about 50 to 55% in a single rolling pass. At the same time, the increased exit strip tension will result in a reduced lever arm of the work roll of the cold rolling mill and will substantially reduce all of the roll separating force, motor torque and roll mill power of the apparatus.

DETAILED DESCRIPTION OF THE INVENTION

The present invention is an apparatus and method for reducing the total number of required rolling passes of metal strip in a cold rolling mill to achieve a desired metal strip thickness. This is accomplished by increasing the exit strip tension of the metal strip of at least about 60% up to about 85% of the yield strength Y of the rolled strip. This increase in exit strip tension allows a manufacturer to process metal strip in an apparatus at a maximum thickness reduction of about 50 to 55% in a single rolling pass.

To accomplish the present invention, a model was developed into which data on the following parameters are input:

| | |
|---|---|
| R = | work roll radius |
| $h_i$ = | strip entry thickness |
| $h_o$ = | strip exit thickness |
| $h_a$ = | strip average thickness |
| w = | strip width |
| P = | roll separating force |
| p = | rolling pressure along the arc of contact in the roll bite |
| $p_a$ = | average rolling pressure along the arc of contact in the roll bite |
| $m^-$ = | lever arm |
| $m_A$ = | lever arm for case A (conventional rolling) |
| $m_B$ = | lever arm for case B (extrusion rolling according to the present invention) |
| L = | roll contact length |
| $s_i$ = | strip entry tension |
| $s_o$ = | strip exit tension |
| Y = | strip yield strength |
| W = | rolling mill motor power |
| T = | rolling mill motor torque |
| $V_o$ = | strip exit speed |

Figure 1:
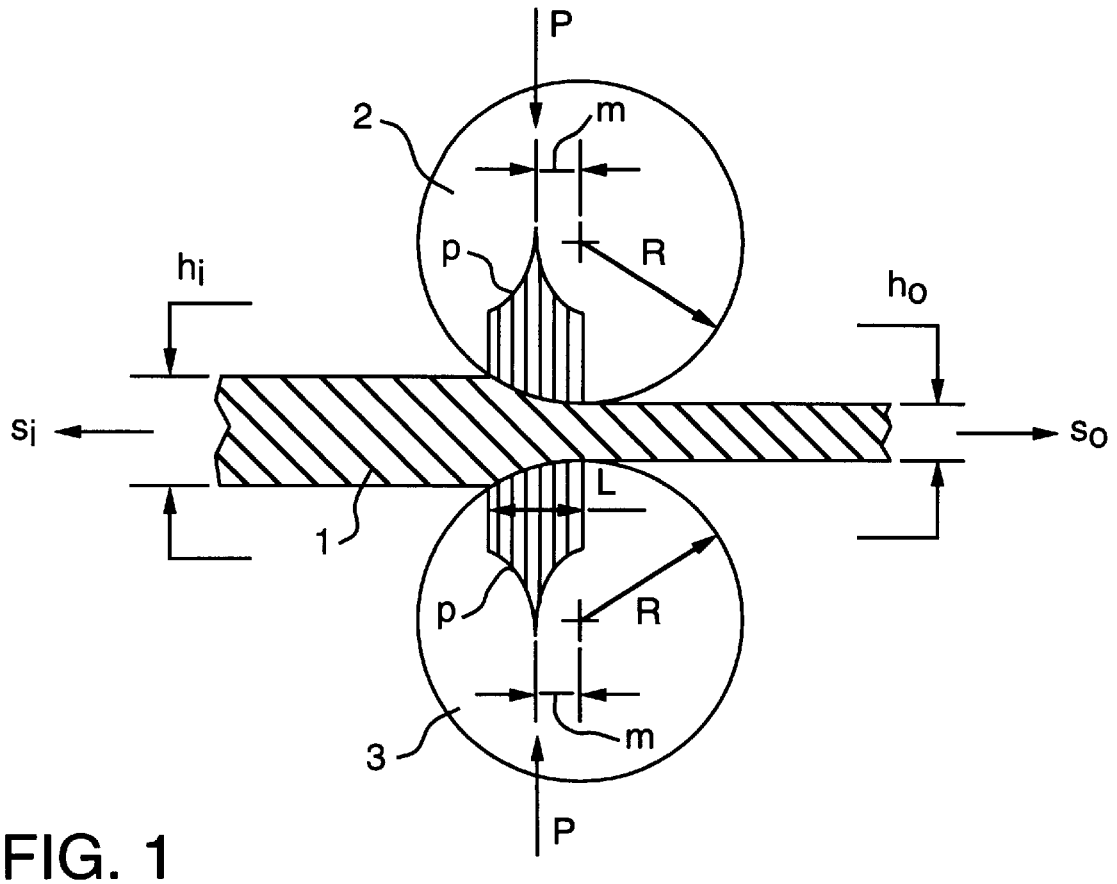
FIG. 1 is a schematic view of a length of metal strip passing between two work rolls of a cold rolling mill.

FIG. 1 illustrates a length of strip passing between two work rolls with the above variables labeling their respective parameters or measurements.

Figure 3:
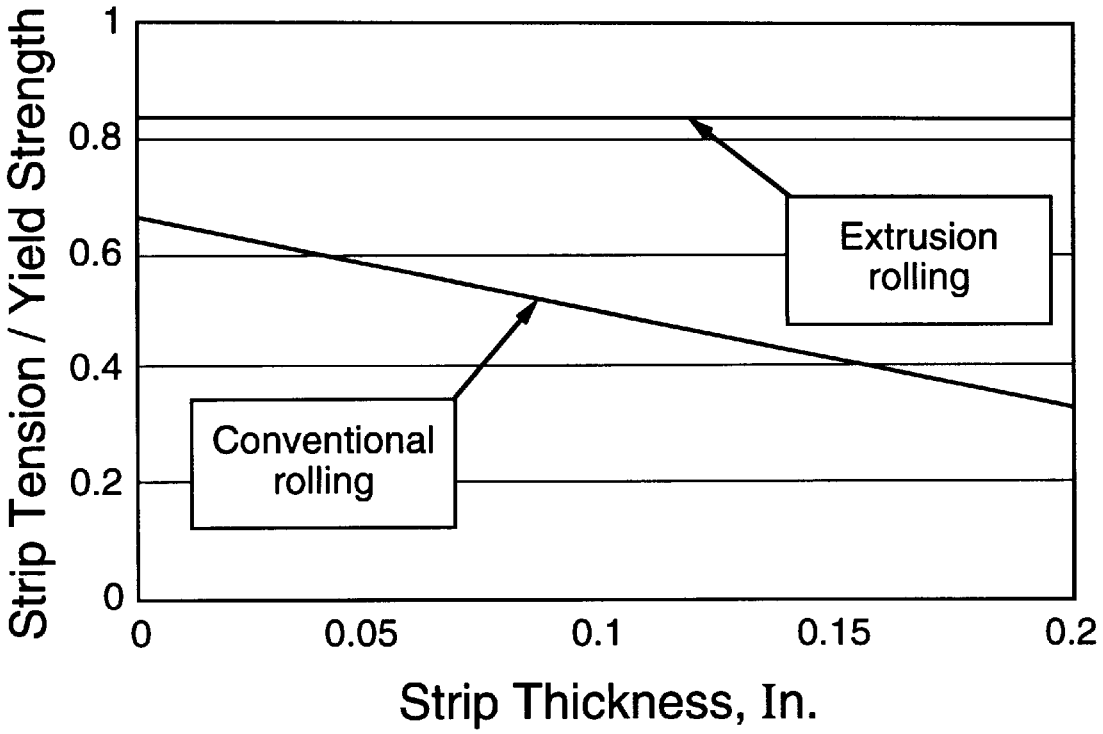
FIG. 3 is a graph of strip tension/yield strength versus strip thickness.

Presently, in cold rolling mills, the entry strip tension $s_i$ is selected in the range between 4 to 6% of the strip yield strength Y for the first pass and between 35 to 65% for the remaining passes. The exit strip tension $s_o$ is selected approximately between 35 to 65% of the strip yield strength Y as shown in FIG. 3, except for the last pass when the exit tension is limited to 5 to 10% of the strip yield strength Y. Under these conditions, the maximum thickness reduction of the strip in one rolling pass is usually limited to 40–45%. Because of that, the number of rolling passes during cold rolling can be as many as five passes.

The model developed that led to the present invention is as follows:

The average rolling pressure in the roll bite $p_a$ is strongly affected by the strip tension as given by the equation (FIG. 1):

$$p_a = \frac{P}{wL} = 1.15Y\left(1 - \frac{s_i + s_o}{2.3Y}\right) \quad (1)$$

where the variables are the same as defined above. Thus, the average rolling pressure $P_a$ decreases with increase in both entry and exit strip tensions, $s_i$ and $s_o$.

The rolling mill power required for rolling W is equal to:

$$W = wV_o(1.15Y(h_i - h_o) + (s_i h_i - s_o h_o))$$

where the variables are the same as defined above.

Thus, an increase in entry strip tension $s_i$ increases rolling mill power W, whereas the increase in exit strip tension $s_o$ reduces the rolling mill power W.

The motor torque is equal to:

$$T = 2mP + wR(s_i h_i - s_o h_o) \quad (3)$$

where m=lever arm, and the remaining variables are the same as defined above. When entry strip tension $s_i$ increases the lever arm m increases. Conversely, when the exit strip tension $s_o$ increases the lever arm m decreases.

Figure 2:
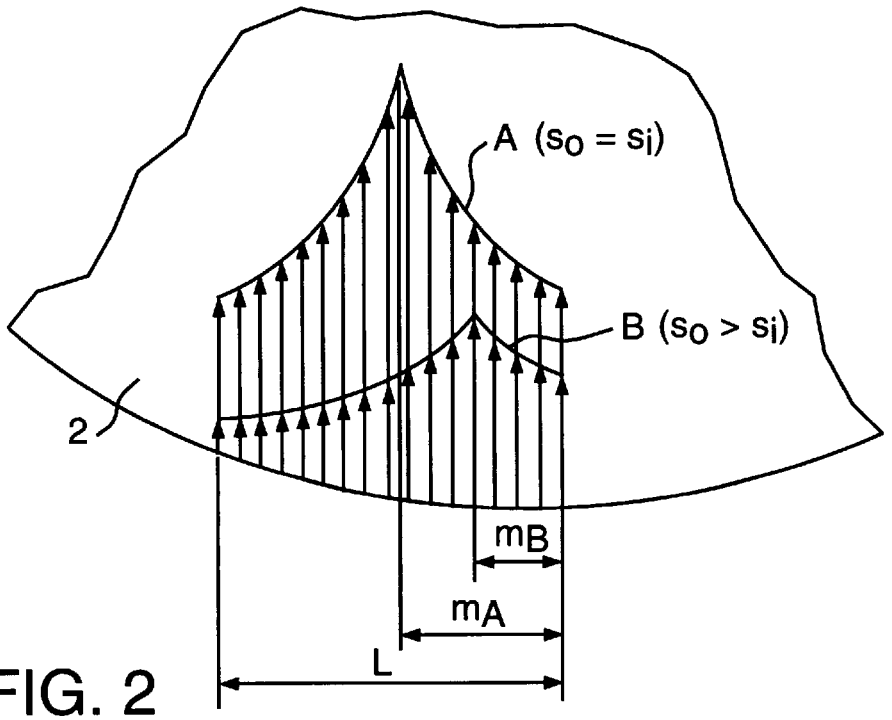
FIG. 2 is a schematic view of the rolling pressure along the arc of contact in the roll bite of a work roll in a cold rolling mill.

FIG. 2 shows the distribution of the rolling pressure p in the roll bite for two cases. Case A is when $s_o = s_i$ results in lever arm $m_A$ and case B is when $s_o > s_i$ results in lever arm $m_B$. Thus, the increase in entry strip tension $s_i$ increases rolling mill torque T, whereas the increase in exit strip tension $s_o$ reduces the rolling mill torque T.

The apparatus and method of the present invention is accomplished by increasing the exit strip tension $s_o$ from at least about 60% up to about 85% of the yield strength Y of the rolled strip. This allows an increase to a maximum thickness reduction to about 50–55% for a single rolling pass. At the same time, the increased exit strip tension $s_o$ will result in a reduced lever arm m, and subsequently, will reduce the roll separating force, motor torque T, and rolling mill power W.

Further improvement is achieved by reducing the entry strip tension $s_i$ to be as low as 4 to 6% of the strip yield strength Y for all passes. In that case, the improvement is achieved by reducing the lever arm m.

Figure 4:
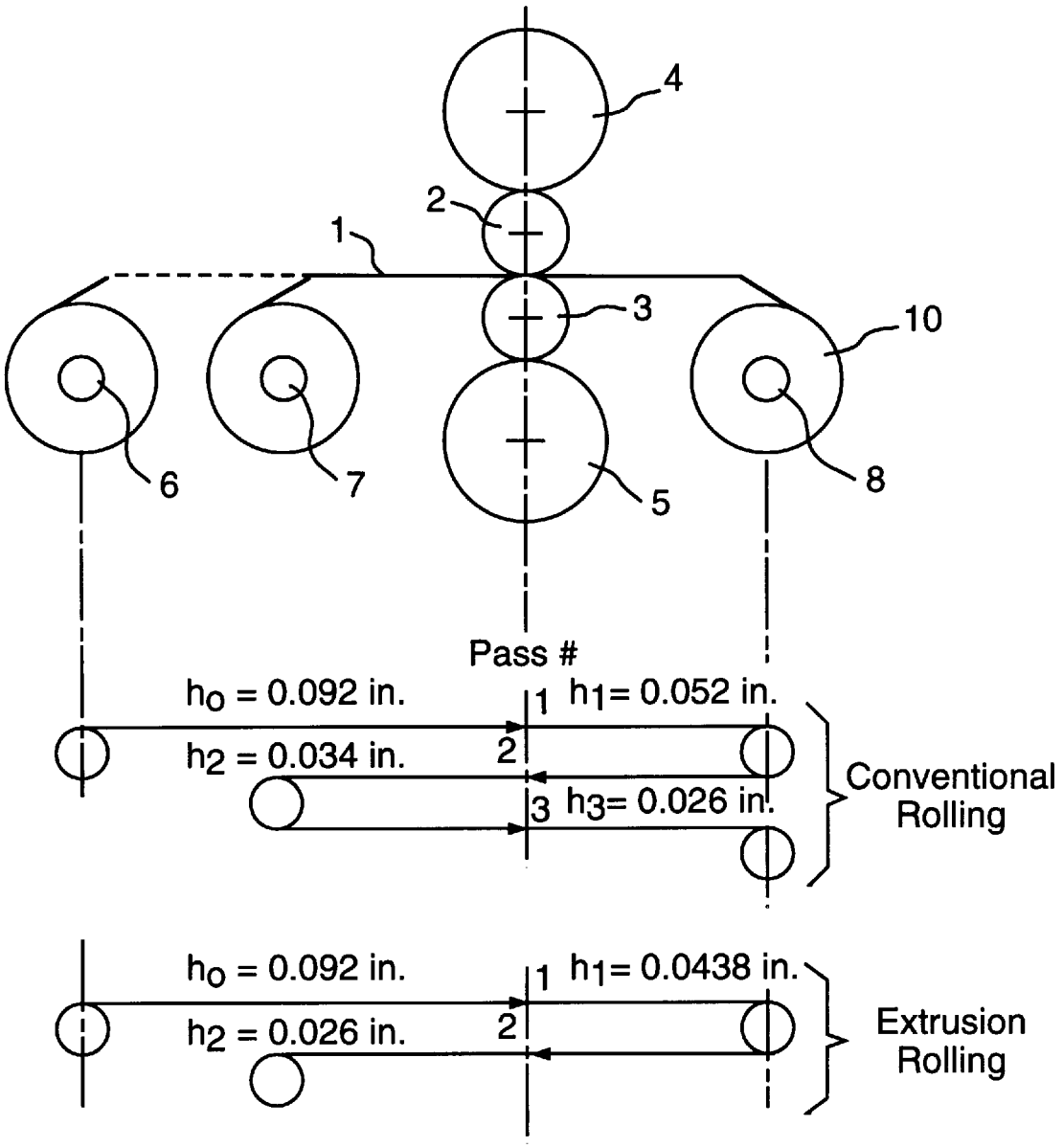
FIG. 4 is a schematic view of a single stand cold rolling mill of the present invention with a conventional rolling and extrusion rolling according to the present invention, comparative example.

Referring to FIG. 4 the method of the present invention is preferably practiced on a single stand cold rolling reversing mill having at least one top work roll 2 and at least one bottom work roll 3 on opposite sides of a metal strip 1, for example steel or aluminum strip, to be processed. The cold rolling mill also includes at least one top backup roll 4 in contacting relationship with at least one top work roll 2 and at least one bottom backup roll 5 in contacting relationship with at least one bottom work roll 3. The mill further has at least one pay-off reel 6 in front of at least one entry tension reel 7 and at least one exit tension reel 8 on the opposite side of the single stand for the collection of rolled coil 10 after metal strip 1 has passed through at least one top work roll 2 and at least one bottom work roll 3.

As shown in FIG. 4 the method of the present invention is accomplished by increasing power of either only at least one exit tension reel 8 or both at least one entry tension reel 7 and at least one exit tension reel 8. Table 1 below shows an example of motor parameters for both conventional and extrusion rolling of the present invention when the power of the entry tension reel 7 and exit tension reel 8 is increased for extrusion rolling:

TABLE 1

67 in. (1700 mm) Single Strand Reversing Cold Mil
MOTOR PARAMETERS
Extrusion Rolling versus Conventional Rolling Annual Production, short tons 1000000
Mill Utilization Factor, % 85

| | Power, hp | | Motor RPM | | Gear ratio | |
|---|---|---|---|---|---|---|
| Stand | Convent. | Extrusion | Convent. | Extrusion | Convent. | Extrusion |
| Pay-off reel | 2000 | 2000 | 480/1500 | 480/1500 | 1.9 | 1.9 |
| Entry tension reel | 5000 | 12000 | 480/1500 | 480/1500 | 1.8 | 1.8 |
| Reversing mill | 12000 | 12000 | 600/1200 | 600/1200 | 1.0 | 1.0 |
| Exit tension reel | 5000 | 12000 | 480/1500 | 480/1500 | 1.8 | 1.8 |

FIG. 4 and Table 2 below show an example of a rolling schedule that is performed in three passes by using conventional rolling and in two passes by using extrusion rolling of the present invention:

TABLE 2

Comparison of reduction schedules
of conventional and extrusion rolling

| | Conventional rolling | | Extrusion rolling | |
|---|---|---|---|---|
| Pass # | Exit thickness, in. | Percent reduction, % | Exit thickness, in. | Percent reduction, % |
| | 0.092 | | 0.092 | |
| 1 | 0.052 | 43.5 | 0.0438 | 52.4 |
| 2 | 0.034 | 34.6 | 0.026 | 40.6 |
| 3 | 0.026 | 23.5 | | |

The comparison of reduction schedules is schematically shown at the bottom of FIG. 4.

Figure 5:
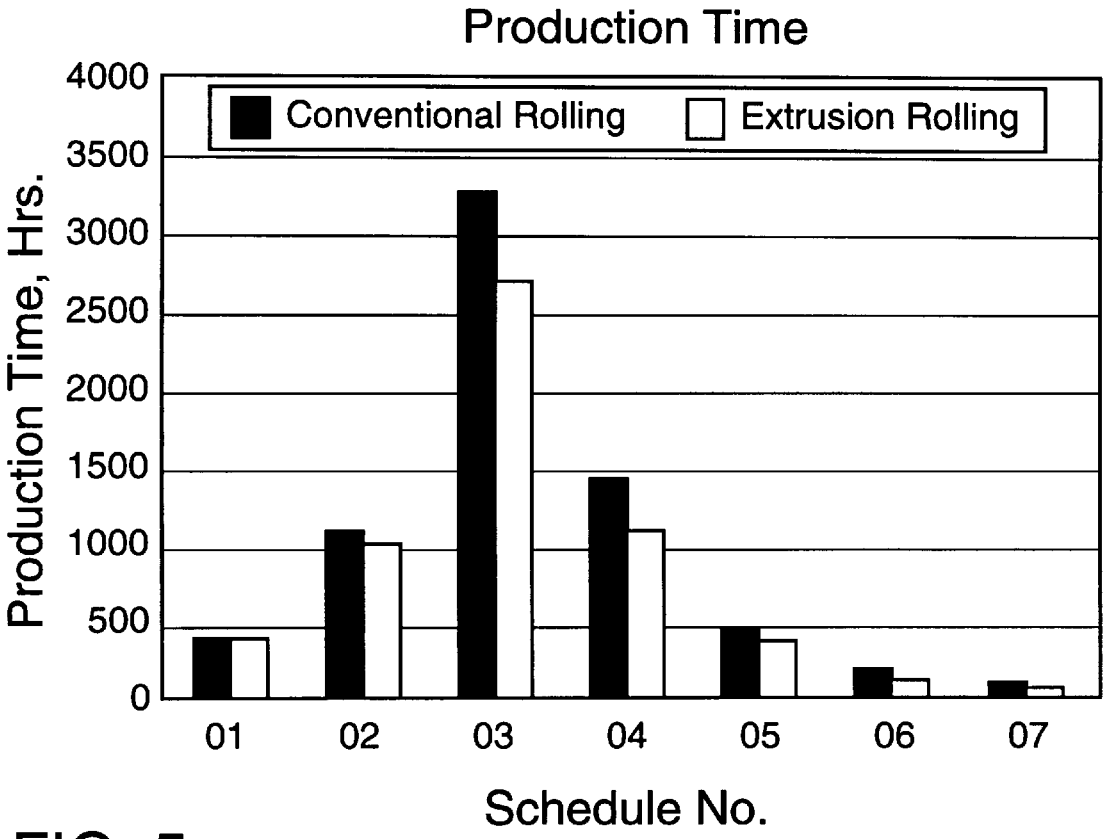
FIG. 5 is a graph of production time hours comparing conventional rolling with extrusion rolling according to the present invention.

FIG. 5 and Table 3 below give a comparison of production times for the conventional and extrusion rolling of the present invention:

TABLE 3

67 in. (1700 mm) Single Strand Reversing Cold Mill
Production Capability Study
Extrusion Rolling versus Conventional Rolling Annual Production, short tons 1000000
Mill Utilization Factor, % 85

| SCHED. | Entry thickness | Exit thickness | Width | Percent of product | Number of passes | | Production rate, tph | | Production time, hrs | |
|---|---|---|---|---|---|---|---|---|---|---|
| # | in. | in. | in. | mix | Convent. | Extrusion | Convent. | Extrusion | Convent. | Extrusion |
| 01AVE | 0.090 | 0.025 | 27 | 5.00 | 2 | 2 | 102.15 | 104.46 | 416.1 | 406.9 |
| 02AVE | 0.094 | 0.026 | 35 | 15.00 | 2 | 2 | 117.02 | 125.95 | 1089.6 | 1012.3 |
| 03AVE | 0.092 | 0.026 | 42 | 45.00 | 3 | 2 | 116.56 | 140.64 | 3281.6 | 2719.7 |
| 04AVE | 0.086 | 0.033 | 47.5 | 25.00 | 3 | 2 | 146.21 | 194.46 | 1453.4 | 1092.8 |
| 05AVE | 0.086 | 0.0175 | 47.5 | 5.00 | 4 | 3 | 89.27 | 112.32 | 476.1 | 378.4 |
| 06AVE | 0.071 | 0.026 | 54 | 3.00 | 3 | 2 | 149.05 | 192.92 | 171.1 | 132.2 |
| 07AVE | 0.130 | 0.057 | 54 | 2.00 | 4 | 3 | 162.2 | 211.04 | 104.8 | 80.6 |
| | | | TOTAL: | 100 | | | | TOTAL: | 6992.5 | 5822.8 |

Table 3 is the data used to create the graph of FIG. 5.

While there has been illustrated and described several embodiments of the present invention, it will be apparent that various changes and modifications thereof will occur to those skilled in the art. It is intended in the appended claims to cover all such changes and modifications that fall within the true spirit and scope of the present invention.

We claim:

1. A single stand cold rolling reversing mill system comprising:

at least one reversing mill top work roll for contacting a top surface of metal strip;

at least one top backup roll in a contacting relationship with said at least one top work roll;

at least one reversing mill bottom work roll for contacting a bottom surface of metal strip;

at least one bottom backup roll in a contacting relationship with said at least one bottom work roll;

at least one pay-off reel for feeding metal strip between said at least one top work roll and said at least one bottom work roll;

at least one entry tension reel for guiding and applying force to metal strip entering and exiting said single cold rolling mill;

at least one exit tension reel for guiding and applying force to metal strip exiting and entering said single stand cold rolling mill;

whereby said at least one tension reel creates an exit tension on said metal strip up to about 85% of the yield strength of said metal strip thereby allowing up to about 55% reduction of strip thickness per pass of the strip through the mill.

2. A method of rolling metal strip in a reversing mill having at least one upper and at least one lower work roll, at least one entry reel for applying tension to the strip, and at least one exit reel for applying tension to the strip, comprising establishing an exit strip tension of at least about 60% and up to about 85% of the yield strength of the strip, and reducing the strip thickness by at least about 50% per pass of the strip through the mill.

3. A method according to claim 2, wherein, by applying said level of exit tension to the strip to at least about 60% and up to about 85% of the yield strength of the strip, the roll separating force, (P) the rolling mill power (W) and the mill motor torque (T) are reduced in accordance with the relationships:

$$p_a = \frac{P}{wL} = 1.15Y\left(1 - \frac{s_i - s_o}{2.3Y}\right) \quad \text{(to be solved for } P\text{);}$$

(to be solved for P);

$$W = wV_o(1.15Y(h_i - h_o) + (s_i h_i - s_o h_o)) \quad \text{(to be solved for W); and}$$

$$T = 2mP + wR(s_i h_i - S_o h_o) \quad \text{(to be solved for T)}$$

where:

$P_a$ average rolling pressure along the arc of contact in the roll bite, w=strip width, L=roll contact length, Y=strip yield strength, $S_i$ strip entry tension, $s_o$=strip exit tension, $V_o$ strip exit speed, $h_i$=strip entry thickness, $h_o$ strip exit thickness, m=in lever arm, and R=work roll radius.

4. A method according to claim 3, further comprising establishing an entry strip tension in the range of about 4 to 6% of the yield strength of the strip.

5. A single stand cold rolling reversing mill system comprising:

a reversing mill top work roll for contacting a top surface of metal strip;

at least one top backup roll in a contacting relationship with said top work roll;

a reversing mill bottom work roll for contacting a bottom surface of metal strip;

at least one bottom backup roll in a contacting relationship with said bottom work roll;

an entry tension reel for guiding and applying force to metal strip entering and exiting said single stand cold rolling reversing mill;

an exit tension reel for guiding and applying force to metal strip exiting and entering said single stand cold rolling reversing mill;

wherein one of said two tension reels creates an exit tension on said metal strip up to about 85% of the yield strength of said metal strip thereby allowing up to about 55% reduction of strip thickness per pass of the strip through the mill.

6. A single stand cold rolling reversing mill system according to claim 5, wherein a remaining tension reel, of said two tension reels, creates an entry tension on said metal strip in the range of about 4 to 6% of the yield strength of said metal strip.

* * * * *